US009229360B2

(12) United States Patent
Lee et al.

(10) Patent No.: US 9,229,360 B2
(45) Date of Patent: Jan. 5, 2016

(54) ELECTROPHOTOGRAPHIC IMAGE FORMING APPARATUS TO CONTROL THE SUPPLY OF TONER TO THE DEVELOPER

(71) Applicant: Samsung Electronics Co., Ltd., Suwon-si (KR)

(72) Inventors: Hyun-cheol Lee, Suwon-si (KR); Dae-ho Kim, Seoul (KR); Jin-hong Kim, Gwangmyeong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/291,725

(22) Filed: May 30, 2014

(65) Prior Publication Data

US 2015/0117877 A1 Apr. 30, 2015

(30) Foreign Application Priority Data

Oct. 30, 2013 (KR) ..... 10-2013-0130453

(51) Int. Cl.
*G03G 15/08* (2006.01)

(52) U.S. Cl.
CPC ..... *G03G 15/0824* (2013.01); *G03G 15/0877* (2013.01)

(58) Field of Classification Search
CPC ..... G03G 15/0824; G03G 15/0831; G03G 15/0822; G03G 15/0832
See application file for complete search history.

(56) References Cited

U.S. PATENT DOCUMENTS

| | | | | |
|---|---|---|---|---|
| 7,848,664 | B2 | 12/2010 | Suenaga et al. | |
| 2011/0206389 | A1 | 8/2011 | Naruse | |
| 2012/0148312 | A1* | 6/2012 | Takahashi | 399/258 |
| 2012/0294632 | A1* | 11/2012 | Nishikawa | 399/27 |
| 2013/0031791 | A1 | 2/2013 | Butzen et al. | |

FOREIGN PATENT DOCUMENTS

| | | |
|---|---|---|
| JP | 4200612 | 10/2008 |
| JP | 4878297 | 12/2011 |
| JP | 4924729 | 2/2012 |

* cited by examiner

*Primary Examiner* — Clayton E LaBalle
*Assistant Examiner* — Ruifeng Pu
(74) *Attorney, Agent, or Firm* — Staas & Halsey LLP

(57) ABSTRACT

An eletrophotographic image forming apparatus may include a developing unit; a toner buffer unit which feeds a toner to the developing unit, and includes an agitating member agitating the toner contained inside the toner buffer unit and a first carrying member carrying the toner contained inside the toner buffer unit to the developing unit; a toner cartridge which feeds the toner to the toner buffer unit, and includes a second carrying member carrying the toner contained inside the toner cartridge to the toner buffer unit; and a control unit which controls a first driving unit driving the second carrying member and a second driving unit driving the agitating member and the first carrying member, and the control unit includes a first feed mode, a second feed mode and a toner supplement mode.

14 Claims, 11 Drawing Sheets

ELECTROPHOTOGRAPHIC IMAGE FORMING APPARATUS TO CONTROL THE SUPPLY OF TONER TO THE DEVELOPER

CROSS-REFERENCE TO RELATED APPLICATIONS

This application claims the priority benefit of Korean Patent Application No. 10-2013-0130453, filed on Oct. 30, 2013, in the Korean Intellectual Property Office, the disclosure of which is incorporated herein in its entirety by reference.

BACKGROUND

1. Field

One or more embodiments relate to an eletrophotographic image forming apparatus which prints an image by feeding toner to an electrostatic latent image formed on a photoconductor, developing the electrostatic latent image, transferring the developed image to a recoding medium, and fixing the developed image to the recoding medium.

2. Description of the Related Art

Eletrophotographic image forming apparatuses print out an image on a recording medium by irradiating modulated light corresponding to image information to a photoconductor, forming an electrostatic latent image on the surface of the photoconductor, feeding toner to this electrostatic latent image to develop a visible image, transferring the visible image to a recording medium, and fixing the visible image to the recording medium.

A developer that develops an electrostatic latent image to a photoconductor may receive the toner from a toner cartridge. A toner buffer unit, which receives the toner from the toner cartridge and feeds the toner to the developer, may be arranged between the developer and the toner cartridge. Thus, the toner may be fed from the toner cartridge to the developer via the toner buffer unit.

The toner buffer unit may include an agitating member to agitate the toner contained inside the agitating member and a carrying member to feed the toner to the developer.

When the agitating member and the carrying member are driven by a single motor, the agitating member and the carrying member are driven altogether. When the agitating member is driven to supplement the toner from the toner cartridge to the toner buffer unit, the carrying member is simultaneously driven. Thus the toner is fed to the developer. In this case, although feeding the toner to the developer is unnecessary, the toner may be continuously fed to the developer due to driving of the carrying member. Finally, the concentration of the toner in the developer may exceed a reference concentration. This may lead to a decrease in the image quality.

On the other hand, when the agitating member and the carrying member are driven by separate motors in order to prevent overfeeding of the toner to the developer, the number of motors is doubled, and, thus increases in size and price of a developing device may occur.

SUMMARY

One or more embodiments may include an eletrophotographic image forming apparatus which may be made compact and may still realize stable toner feeding.

One or more embodiments may include an eletrophotographic image forming apparatus which has a mode capable of sufficiently feeding toner to a developer to address toner deficiency even when image forming processes requiring a large amount of toner are consecutively conducted.

One or more embodiments may include an eletrophotographic image forming apparatus which has a mode capable of charging toner within a short period of time by rotating only an agitating member without rotating a carrying member inside a toner buffer unit.

In an aspect of one or more embodiments, there is provided an eletrophotographic image forming apparatus is provided which includes: a developer; a toner buffer unit, which is connected to the developer and feeds the toner to the developer, including an agitating member agitating the toner contained inside the toner buffer unit and a first carrying member carrying the toner contained inside to the developer; a toner cartridge, which is connected to the toner buffer unit and feeds the toner to the toner buffer unit, including a second carrying member carrying the toner contained inside the toner cartridge unit to the toner buffer unit; and a control unit controlling a first driving unit which drives the second carrying member and a second driving unit which drives the agitating member and the first carrying member, wherein the control unit may include a first feed mode in which the toner is fed from the toner buffer unit to the developer, not from the toner cartridge to the toner buffer unit, a second feed mode in which the toner is fed from the toner cartridge to the toner buffer unit and then from the toner buffer unit to the developer, and a toner supplement mode in which the toner is fed from the toner cartridge to the toner buffer unit and is not fed from the toner buffer unit to the developer.

The control unit controls such that the first driving unit does not drive the second carrying member in the first feed mode and the first driving unit drives the second carrying member in the second feed mode and the toner supplement mode.

The control unit controls such that the second driving unit drives the agitating member and the first carrying member in the first and second feed modes, and the second driving unit does not drive the first carrying member but drives the agitating member in the toner supplement mode.

A driving transfer member may be installed which selectively transfers the driving force of the second driving unit to the first carrying member which is between the second driving unit and the first carrying member.

The driving transfer member may be a one-way clutch.

The second driving unit is rotatable in a first direction and a second direction which is opposite to the first direction, and when the second driving unit rotates in the first direction, the driving transfer member transfers the driving force of the second driving unit to the first carrying member, and when the second driving unit rotates in the second direction, the driving transfer member blocks transferring of the driving force of the second driving unit to the first carrying member.

When the second driving unit rotates in the first direction or second direction, the driving force of the second driving unit may be transferred to the agitating member.

The control unit may synchronize the rotation of the second driving unit in the second direction with the rotation of the first driving unit.

The control unit may further include a first detection unit detecting a concentration of the toner inside the developer and a second detection unit detecting the level of the toner in the toner buffer unit. And the control unit may select one from the first feed mode, the second feed mode and the toner supplement mode, based on the value detected by the first detection unit and the second detection unit.

The control unit may select the first feed mode when the value detected by the first detection unit does not satisfy a first reference value and the value detected by the second detection unit satisfies a second reference value, the second feed mode when the value detected by the first detection unit does not satisfy the first reference value and the value detected by the second detection unit satisfies the second reference value, and the toner supplement mode when the value detected by the first detection unit satisfies the first reference value and the value detected by the second detection unit satisfies the second reference value.

The control unit may determine the toner remains with a driving time of the first driving unit as a reference.

The eletrophotographic image forming apparatus may further include a display unit displaying the toner remains of the toner cartridge.

In an aspect of one or more embodiments, there is provided a method for feeding toner in an image forming apparatus including detecting a first toner concentration contained in a developing unit using a first toner concentration detector positioned in the developing unit; detecting a second toner concentration contained in a toner buffer unit using a second toner concentration detector positioned in the toner buffer unit; selecting one of a first feed mode, a second feed mode, and a toner supplement mode, based on a first toner concentration and a second toner concentration, wherein the toner buffer unit is connected to the developing unit, the toner buffer unit is connected to a toner cartridge, and the toner buffer unit includes an agitating member and a first carrying member, and wherein the toner cartridge includes a second carrying member; and driving the second carrying member in the second feed mode and the toner supplement mode.

This method may further include driving the second carrying member in the first feed mode.

This method may further include driving the agitating member and the first carrying member in the first feed mode and second feed mode.

This method may further include driving the agitating member in the toner supplemental mode and not driving the first carrying member in the toner supplemental mode.

BRIEF DESCRIPTION OF THE DRAWINGS

These and/or other aspects will become apparent and more readily appreciated from the following description of embodiments, taken in conjunction with the accompanying drawings in which.

DETAILED DESCRIPTION

Figure 1:
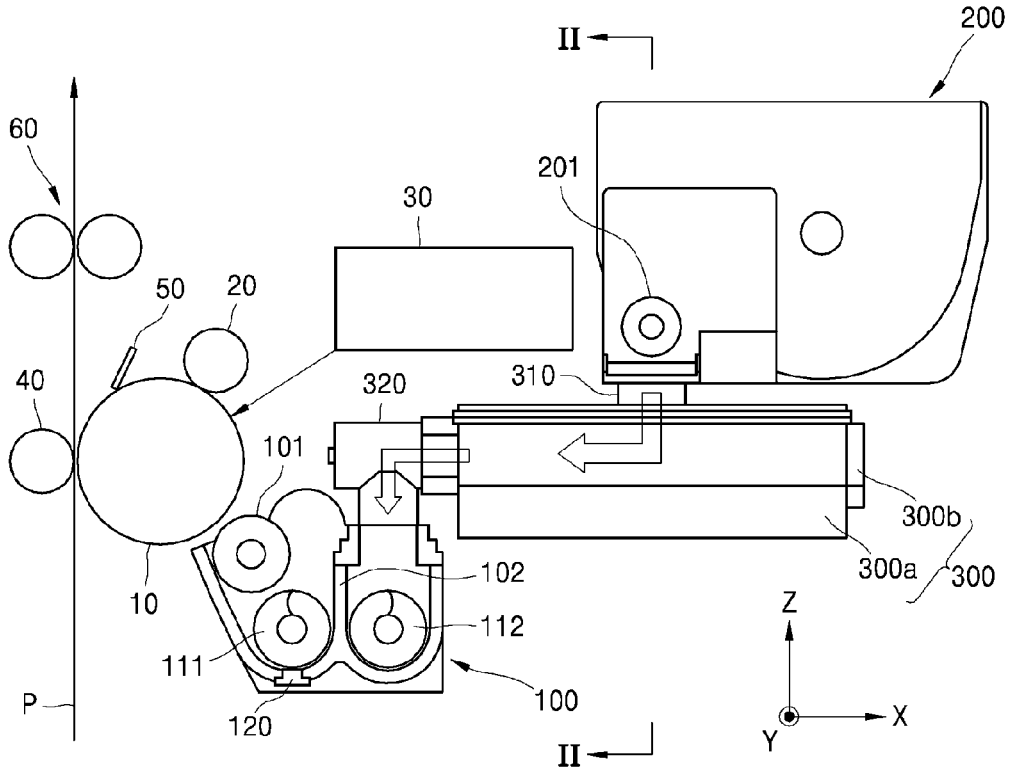
FIG. 1 is a schematic diagram of an eletrophotographic image forming apparatus according to an embodiment.

Reference will now be made in detail to embodiments, examples of which are illustrated in the accompanying drawings, wherein like reference numerals refer to like elements throughout. In this regard, embodiments may have different forms and should not be construed as being limited to the descriptions set forth herein. Accordingly, embodiments are merely described below, by referring to the figures, to explain aspects of the present disclosure.

Figure 2:
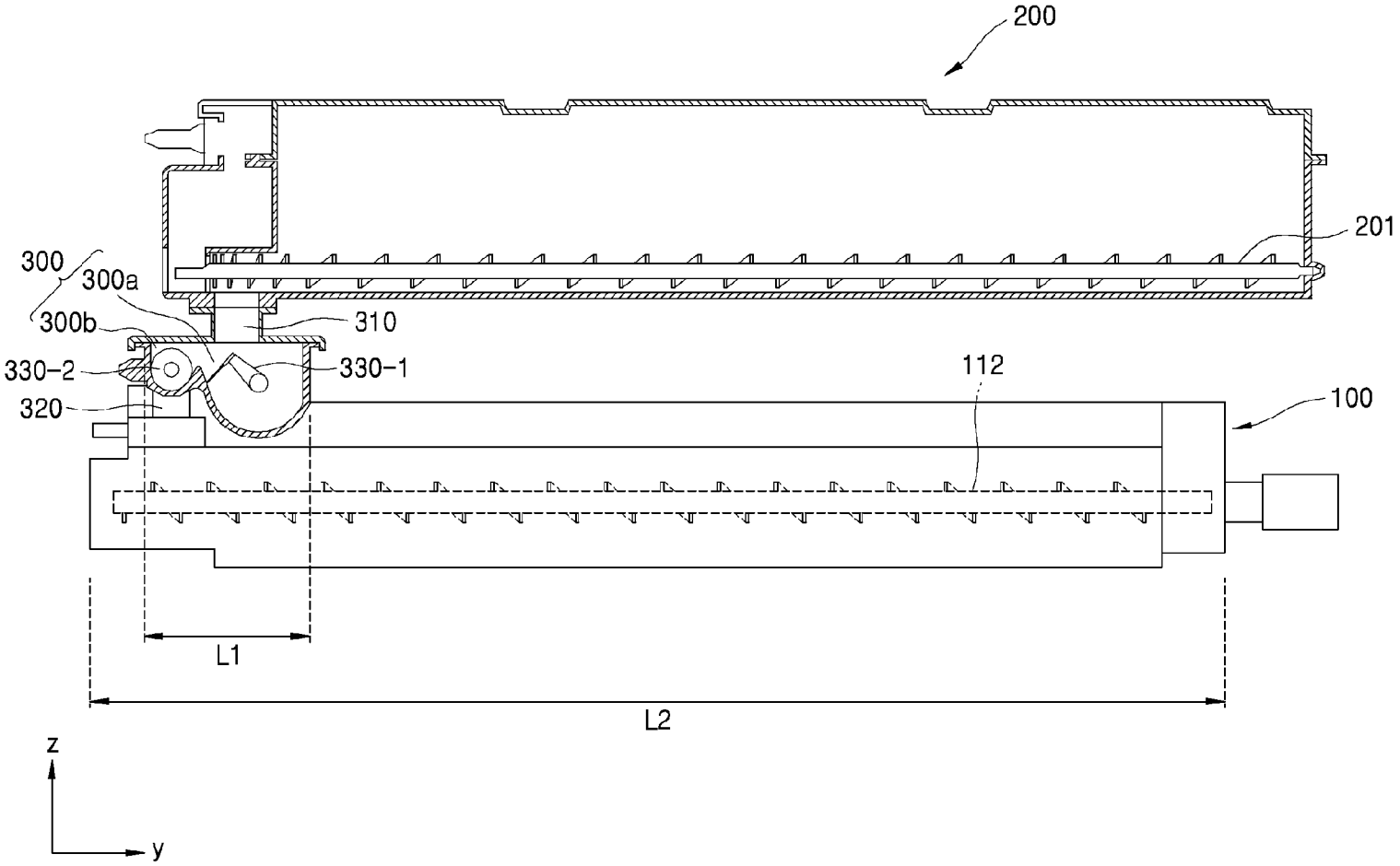
FIG. 2 is a sectional view of the eletrophotographic image forming apparatus along line II-II of FIG. 1.
Figure 3:
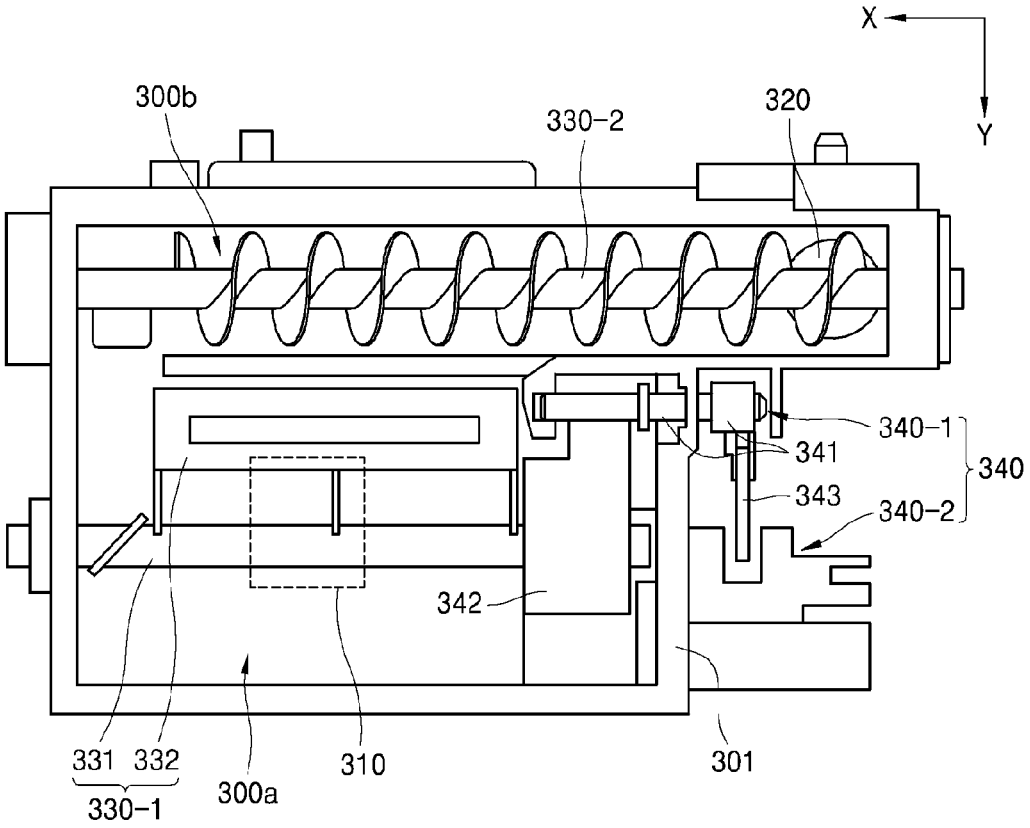
FIG. 3 is a cross-section of a toner buffer unit according to an embodiment.
Figure 4:
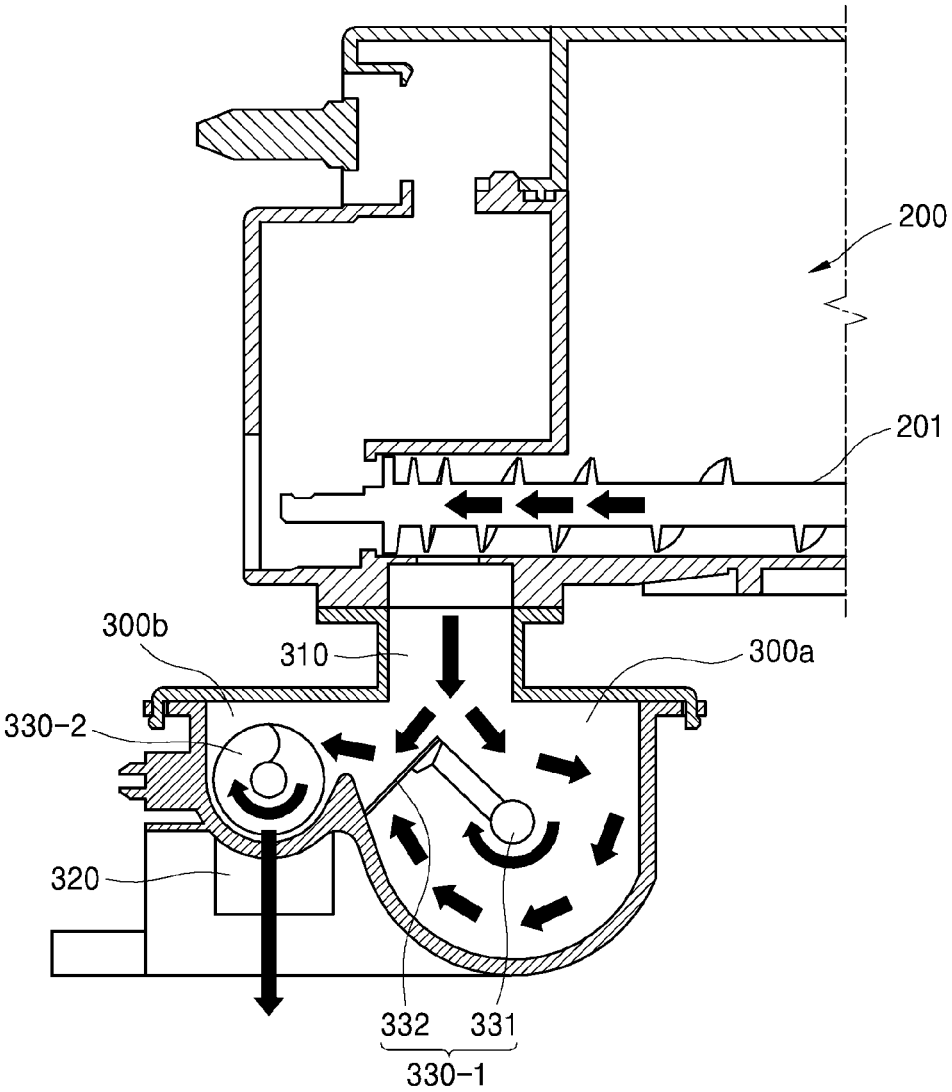
FIG. 4 is a longitudinal section of a toner buffer unit according to an embodiment.

FIG. 1 is a schematic diagram of an eletrophotographic image forming apparatus according to an embodiment. FIG. 2 is a sectional view of the eletrophotographic image forming apparatus of FIG. 1, taken along line II-II of FIG. 1. FIG. 3 is a cross-section of a toner buffer unit 300, according to an embodiment. FIG. 4 is a longitudinal section of the toner buffer unit 300, according to an embodiment. The eletrophotographic image forming apparatus according to an embodiment is a single-color image forming apparatus using two-component toner. The color of the toner is, for example, black.

Referring to FIG. 1, a photoconductive drum 10 is obtained by forming a photoconductive layer with photoconductivity, which is an example of a photoconductor in which an electrostatic latent image is formed, on the outer circumference of a cylindrical metal pipe. The photoconductive drum 10 may be replaced by a photoconductive belt obtained by forming a photoconductive layer on the outer surface of a rotating belt.

A charging roller 20 is an example of a charger which charges the surface of the photoconductive drum 10 with uniform charging potential. The charging roller 20 rotates in contact with the photoconductive drum 10. A charging bias voltage is applied to the charging roller 20. The charging roller 20 may be replaced by a corona charger (not illustrated) which charges the surface of the photoconductive drum 10 by generating a corona discharge.

An exposure unit 30 irradiates a beam corresponding to image information onto the surface of the photoconductive drum 10 and forms an electrostatic latent image. A laser scanning unit (LSU) which deflects a beam irradiated from a laser diode in a main scanning direction by using a polygon mirror in order to scan the photoconductive drum 10 may be used as the exposure unit 30, but embodiments are not limited thereto.

A developing unit 100 contains a developing agent. The developing unit 100 feeds toner out of the developing agent to the electrostatic latent image formed on the photoconductive drum 10, and forms a visible toner image on the surface of the photoconductive drum 10.

A transfer roller 40 is an example of a transfer unit which transfers the toner image formed on the photoconductive drum 10 to paper. The transfer roller 40 forms a transfer nip by facing the photoconductive drum 10, and a transfer bias voltage is applied to the transfer roller 40. A transfer electric field is formed between the photoconductive drum 10 and the transfer roller 40 by the transfer bias voltage. The toner image formed on the surface of the photoconductive drum 10 is transferred to a recording medium P by the transfer electric field generated on the transfer nip recording medium P. The transfer roller 40 may be replaced by a corona transfer unit which uses corona discharge.

The toner remaining on the surface of the photoconductive drum 10 after transferring is removed by a cleaning member 50. The cleaning member 50 may be, for example, a blade of which one end contacts the photoconductive drum 10, or a roller, a brush, or the like which rotates in contact with the photoconductive drum 10.

The toner image transferred to the recording medium P is attached to the recording medium P by an electrostatic force. A fusing unit 60 bonds the toner image to the recording medium P by applying heat and pressure to the toner image.

The developing unit 100 feeds the developing agent contained therein to the electrostatic latent image formed on the photoconductive drum 10, and develops the electrostatic latent image to a visible image. The developing unit 100 contains the toner and a carrier. A developing roller 101 is provided to feed the toner inside the developing unit 100 to the photoconductive drum 10. A developing bias voltage may be applied to the developing roller 101.

The developing roller 101 is separated from the photoconductive drum 10 by several tens to hundreds of micron. Although not illustrated, the developing roller 101 may be obtained by arranging a magnetic roller within a hollow cylindrical sleeve. The toner is attached to the surface of a magnetic carrier. The magnetic carrier with the toner is attached to the surface of the developing roller 101 and transferred to a developing area in which the photoconductive drum 10 and the developing roller 101 face each other. Only the toner is fed to the photoconductive drum 10 due to the developing bias voltage applied between the developing roller 101 and the photoconductive drum 10, and thus the electrostatic latent image on the surface of the photoconductive drum 10 is developed into a visible toner image.

The developing unit 100 may include first and second carrying members 111 and 112 which mix and agitate the toner and the carrier and carry them to the developing roller 101. The first carrying member 111 is disposed in a direction approximately perpendicular to the developing roller 101 such as to face the developing roller 101, and feeds a mixed and agitated developing agent to the developing roller 101. The second carrying member 112 mix and agitate the developing agent to sufficiently charge the developing agent, and carries the charged developing agent to the first carrying member 111. The first and second carrying members 111 and 112 may each be, for example, an auger which includes a rotation shaft extending in a longitudinal direction, y-axis direction, of the developing roller 101 and a spiral wing formed on the outer circumference of the rotation shaft.

The first carrying member 111 and the second carrying member 112 are arranged in parallel with each other. A partition 102 is installed between the first carrying member 111 and the second carrying member 112. The partition 102 has an opening, not illustrated, installed such that the developing agent carried by the first carrying member 111 and the second carrying member 112 is connected and transferred at both ends of each carrying member 111, 112.

The developing agent carried by the second carrying member 112 is carried to the outer circumferential surface of the developing roller 101 by the first carrying member 111.

The developing unit 100 may include a first detection unit 120 to detect the concentration of the toner contained in the developing agent included in the developing unit 100. For example, the first detection unit 120 may be provided near the first carrying member 111. When the toner concentration detected by the first detection unit 120 decreases below an allowable concentration, the toner may be fed from the toner buffer unit 300 (developer buffer unit). The developing unit 100 may receive the toner from the toner buffer unit 300 through the area in which the second carrying member 112 is provided.

The toner contained in a toner cartridge 200 (developer cartridge) is fed to the developing unit 100. When all of the toner contained in the toner cartridge 200 is consumed, the toner cartridge 200 may be replaced by a new toner cartridge 200, thus new toner may be filled up. To this end, a detection unit is needed to detect the remaining amount of the toner in the toner cartridge 200. When the detection unit is provided in the toner cartridge 200, a printing process may be performed only after the toner cartridge 200 is replaced after complete consumption of the toner of the toner cartridge 200 is detected. In other words, the printing process may not be performed until the consumption of the toner is checked and a new toner cartridge 200 is provided. Also, since the toner cartridge 200 is an expendable item that needs to be periodically replaced, the detection unit provided within the toner cartridge 200 may not generally use a high-priced detection device, which leads to a decrease in detection accuracy.

To address this problem and stably feed the toner to the developing unit 100, the toner buffer unit 300, which temporarily contains toner, is provided between the toner cartridge 200 and the developing unit 100. The toner buffer unit 300 receives toner from the toner cartridge 200, contains a predetermined amount of toner, and then transfers the contained toner to the developing unit 100. A second detection unit 340 is installed in the toner buffer unit 300. According to this structure, even when the toner in the toner cartridge 200 is completely consumed, some toner remains in the toner buffer unit 300, and thus the printing process may be performed until a new toner cartridge 200 is provided. Also, since the toner buffer unit 300 is not to be replaced like the toner cartridge 200 and has a relatively much longer replacement period than the toner cartridge 200, a relatively high-priced detection device may be adopted as the second detection unit 340.

Referring to FIGS. 1 and 2, the developing unit 100 and the toner cartridge 200 are arranged in a width direction X, and each extends in a depth direction Y perpendicular to the width direction X. The depth direction Y is an axial direction of the photoconductive drum 10 or the developing roller 101. The toner cartridge 200 is separated from the developing unit 100 in the width direction X and a gravity direction Z. The toner cartridge 200 is arranged above the developing unit 100 in the gravity direction Z. The toner buffer unit 300 may be arranged between the developing unit 100 and the toner cartridge 200 in the gravity direction Z.

Referring to FIGS. 3 and 4, the toner buffer unit 300 extends in the width direction X perpendicular to the axial direction of the photoconductive drum 10, and connects the toner cartridge 200 to the developing unit 100. The toner buffer unit 300 includes a first buffer portion **300*a* connected to the toner cartridge 200, and a second buffer portion 300*b* connected to the developing unit 100. The toner fed from the toner cartridge 200 passes through the first buffer portion 300*a* and the second buffer portion 300*b*, and is fed to the developing unit 100. The first buffer portion 300*a* and the second buffer portion 300*b* extend in the width direction X. The first buffer portion 300*a* and the second buffer portion 300*b* are arranged in the depth direction Y (a second direction) which is the axial direction of the photoconductive drum 10**.

Referring to FIGS. 1 through 4, the first buffer portion **300*a* includes a toner inlet 310 through which the toner flows in from the toner cartridge 200, and the second buffer portion 300***b* includes a toner outlet 320 through which the toner is fed to the developing unit 100. According to an embodiment, the toner inlet 310 extends upward from the top surface of the first buffer portion 300*a* and is connected to the toner cartridge 200, and the toner outlet 320 extends from the lateral surface of the second buffer portion 300*b* in the width direction X, and then again extends downward and is connected to the developing unit 100. The toner inlet 310 is connected to the bottom side of the toner cartridge 200, and toner falls from the toner cartridge 200 to the first buffer portion 300*a* due to the gravity. Also, the toner outlet 320 is connected to the top side of the developing unit 100, and toner falls from the second buffer portion 300*b* to the developing unit 100 due to the gravity.

Referring to FIG. 2, the toner buffer unit 300 needs to be miniaturized, considering the trend toward a miniaturization of a developing device. To this end, a length L1 of the toner buffer unit 300 in the longitudinal direction Y of the developing unit 100 may be about ⅕ to about ½ of a length L2 of the developing unit 100.

Capacities of the first buffer portion 300*a* and the second buffer portion 300*b* need to be increased as much as possible, without increasing the overall size of a developing device. Referring to FIG. 1, in order to prevent the developing device from being enlarged due to the toner buffer unit 300, the toner buffer unit 300 is arranged on the lateral side of the developing unit 100 in the width direction X and beneath the toner cartridge 200. When the second buffer portion 300*b* extends to be lower than the top surface of the developing unit 100, additional equipment is needed to draw up the toner contained in the second buffer portion 300*b* in the gravity direction Z, and thus, the structure of the toner buffer unit 300 may be complex and the component costs and the manufacturing costs may be increased. According to an embodiment, the toner outlet 320 is arranged above the developing unit 100, and the entire second buffer portion 300*b* is arranged on a higher level than the developing unit 100 such that the toner is naturally fed by the gravity to the developing unit 100. Extension of the second buffer portion 300*b* in the gravity direction Z is limited by the toner cartridge 200 and the developing unit 100, and thus the second buffer portion 300*b* may extend in the width direction X. However, since the second buffer portion 300*b* should be arranged between the developing unit 100 and the toner cartridge 200 in the gravity direction Z, a cross-sectional area of the second buffer portion 300*b* in the longitudinal direction is small, and thus, an increase of the toner containment capacity is limited compared with that of the first buffer portion 300*a* even when the second buffer portion 300*b* extends in the width direction X. Thus, it is more useful to extend the first buffer portion 300*a* in order to increase the toner containment capacity of the toner buffer unit 300. An upward extension of toner buffer unit 300 is limited by the toner cartridge 200, but a downward extension thereof is not limited. Thus, as illustrated in FIG. 2, the first buffer portion 300*a* extends downward compared with the second buffer portion 300*b*, and the capacity of the first buffer portion 300*a* is greater than that of the second buffer portion 300*b*. The first buffer portion 300*a* may also extend in the width direction X.

As described above, since the first buffer portion 300*a* extends downward compared with the second buffer portion 300*b*, the toner which is fed from the toner cartridge 200 and contained in the first buffer portion 300*a* needs to be transferred again upward against the gravity to the second buffer portion 300*b* and then to be supplied to the developing unit 100. To this end, as illustrated in FIG. 4, an agitating member 330-1 which agitates and transfers the toner to the second buffer portion 300*b* is provided in the first buffer portion 300*a*.

Referring to FIGS. 3 and 4, the agitating member 330-1 includes a rotation shaft 331 extending in the width direction X, and a carrying wing 332 arranged on the rotation shaft 331. The carrying wing 332 may be, for example, a type of flexible elastic film which has a length in the width direction X and a length in a radial direction. The carrying wing 332 carries the toner in the radial direction. Therefore, when the agitating member 330-1 rotates, the toner contained in the first buffer portion 330*a* is drawn up against the gravity by the carrying wing 332 and transferred to the second buffer portion 300*b*. A first carrying member 330-2 which carries the toner to the toner outlet 320 may be arranged in the second buffer portion 300*b*. For example, the first carrying member 330-2 may include an auger obtained by forming a spiral wing on the outer circumference of a rotation shaft extending in the width direction X. The first carrying member 330-2 with an auger shape may extend to the toner outlet 320. Since the first buffer portion 300*a* extends downward compared with the second buffer portion 300*b*, the center of the agitating member 330-1, namely, the rotation shaft 331, is positioned lower than the center of the first carrying member 330-2. With this structure, the toner containment capacity of the toner buffer unit 300 may be increased.

The toner buffer unit 300 further includes a second detection unit 340 detecting the toner remains. The second detection unit 340 detects the remains of the toner contained in the first buffer portion 300*a*. Referring to FIG. 3, the second detection unit 340 includes an elevator member 340-1 which moves according to the toner level in the first buffer portion 300*a*, and a sensor unit 340-2 detecting the location of the elevator member 340-1. The elevator member 340-1 includes, for example, a supporting shaft 341 which is supported on a sidewall 301 of the first buffer portion 300*a* such as to rotate, and an elevator plate 342 which extends from the supporting shaft 341 into the first buffer portion 300*a* to move up and down according to the toner level. The sensor unit 340-2 may directly or indirectly detect the elevator plate 342. According to an embodiment, the sensor unit 340-2 detects the toner remains of the first buffer portion 300*a* by detecting a detection plate 343 extending from the supporting shaft 341 to the outside of the first buffer portion 300*a*.

The elevator plate 342 is disposed at a location in which the elevator plate 342 is not interfered by the carrying wing 332. For example, the elevator plate 342 is arranged separate from the carrying wing 332 in the axial direction of the rotation shaft 331. When the elevator plate 342 moves up and down according to the toner level, the supporting shaft 341 is rotated and the detection plate 343 moves up and down accordingly. The sensor unit 340-2 detects the toner remains in the first buffer portion 300*a* by detecting the location of the detection plate 343, but a method of detecting the location of the detection plate 343 by the sensor unit 340-2 is not particularly limited. For example, the sensor unit 340-2 may detect the location of the detection plate 343 by a photo-sensor method using a change in a light amount or by a magnetic sensor method using a change in the intensity of an electromagnetic field, according to the locations of the detection plate 343. According to an present embodiment, the sensor unit 340-2 detects the location of the detection plate 343 by the photo-sensor method.

Figure 5:
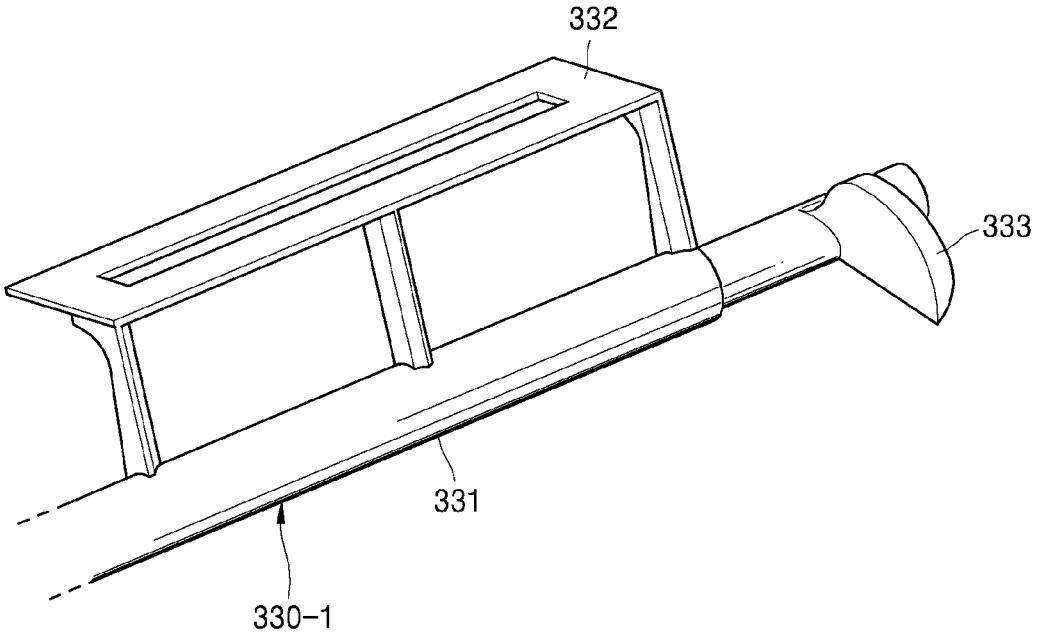
FIG. 5 is a perspective view of an agitating member in which an eccentric cam is arranged according to an embodiment.

FIG. 5 is a perspective view of an agitating member 330-1 on which an eccentric cam 333 is arranged according to an embodiment. Referring to FIG. 5, the eccentric cam 333 is arranged on the rotation shaft 331 of the agitating member 330-1. The eccentric cam 333 contacts the elevator plate 342 as the agitating member 330-1 rotates, and periodically moves up and down the elevator plate 342. A shape of the eccentric cam 333 is not limited to an example illustrated in FIG. 5, and any shape, which moves up and down the elevator plate 342 one time during one rotation of the agitating member 330-1, may be acceptable. The movement of the elevator plate 342 may dust off the toner accumulated on the elevator plate 342 and lift the elevator plate 342 which may be buried in the toner to the surface of the toner. The eccentric cam 333 is arranged outside of the carrying wing 332 of the rotation shaft 331 and contacts the elevator plate 342. The number of parts may be reduced by forming the eccentric cam 333 integrated to the rotation shaft 331 of the agitating member 330-1.

Figure 6:
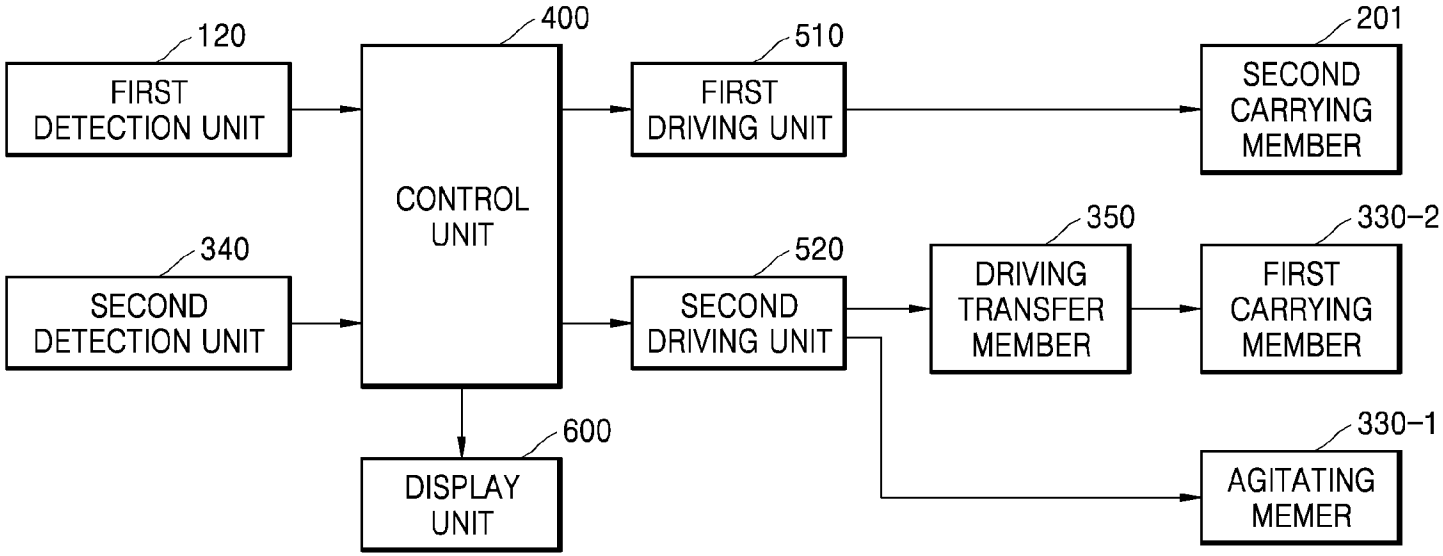
FIG. 6 is a block diagram for controlling the toner feeding of the eletrophotographic image forming apparatus according to an embodiment.

FIG. 6 is a block diagram for controlling the toner feeding of the eletrophotographic image forming apparatus according to an embodiment. Referring to FIG. 6, a first driving unit 510 drives a second carrying member 201, and a second driving unit 520 drives the first carrying member 330-2 and the agitating member 330-1. Each of the first driving unit 510 and the second driving unit 520 may be a single driving device, for example, a motor. A control unit 400 controls the first driving unit 510 and the second driving unit 520. The control unit 400 controls a movement of the first driving unit 510 to control a movement of the second carrying member 201 which is arranged inside of the toner cartridge and controls a movement of the second driving unit 520 to control the movements of the first carrying member 330-2 and the agitating member 330-1 which are arranged inside of the toner buffer unit 300. Therefore, the control unit 400 controls the toner feed from the toner cartridge 200 to the toner buffer unit 300, and the toner feed from the toner buffer unit 300 to the developing unit 100.

The control unit 400 controls the first driving unit 510 which drives the second carrying member 201 and the second driving unit 520 which drives the first carrying member 330-2 and the agitating member 330-1, based on values detected by the first detection unit 120 and the second detection unit 340. The control unit 400 has the stand-by mode, the first feed mode, the second feed mode and the toner supplement mode. And the control unit 400 is set up such that one mode is selected out of the stand-by mode, the first feed mode, the second feed mode and the toner supplement mode, based on values detected by the first detection unit 120 and the second detection unit 340.

Figure 7:
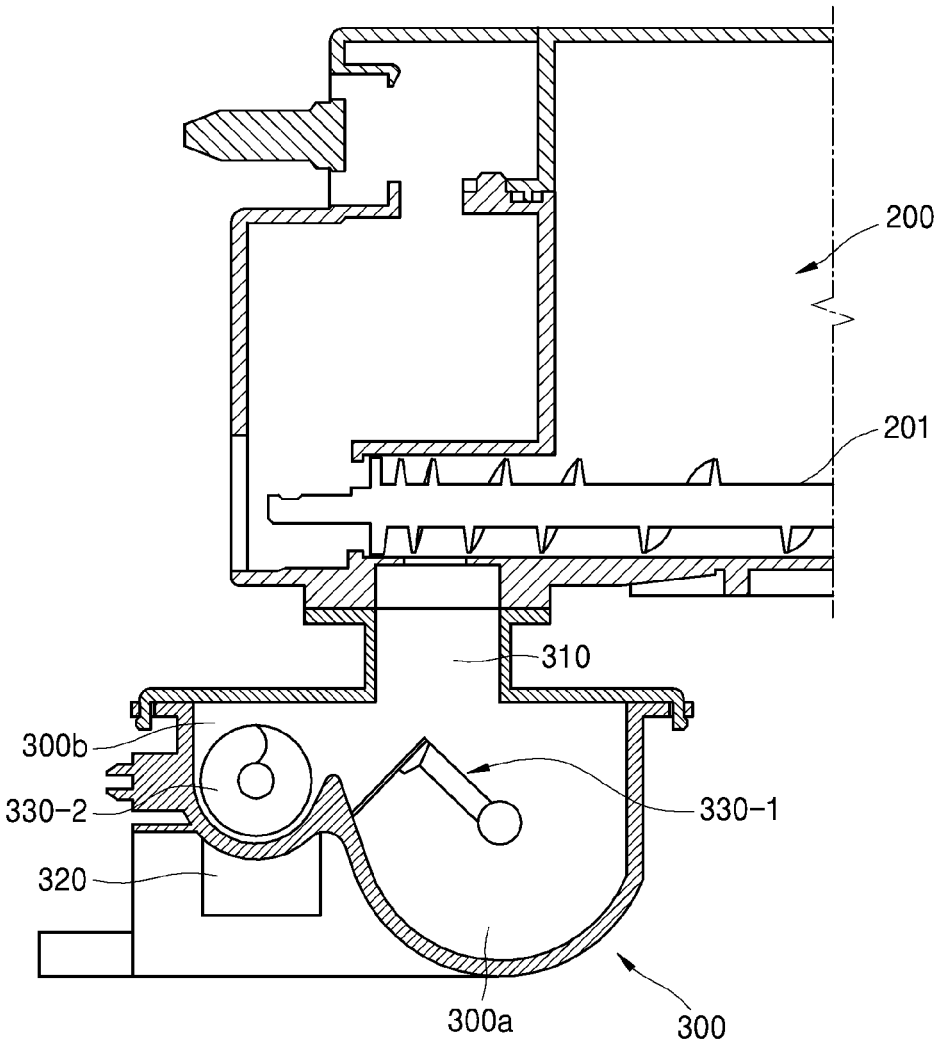
FIG. 7 illustrates a schematic diagram of a toner cartridge and a toner buffer unit when a control unit is in a stand-by mode.
Figure 8:
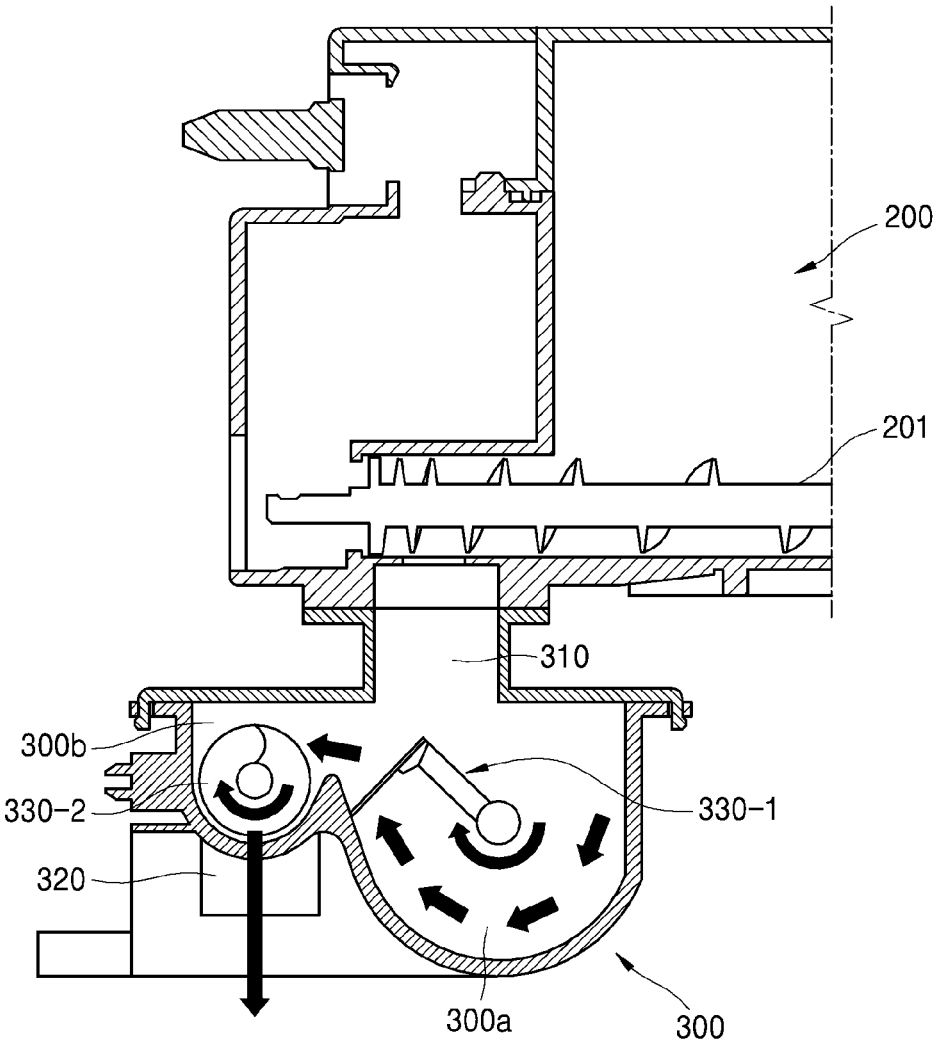
FIG. 8 illustrates a schematic diagram of a toner cartridge and a toner buffer unit when a control unit is in a first feed mode.
Figure 9:
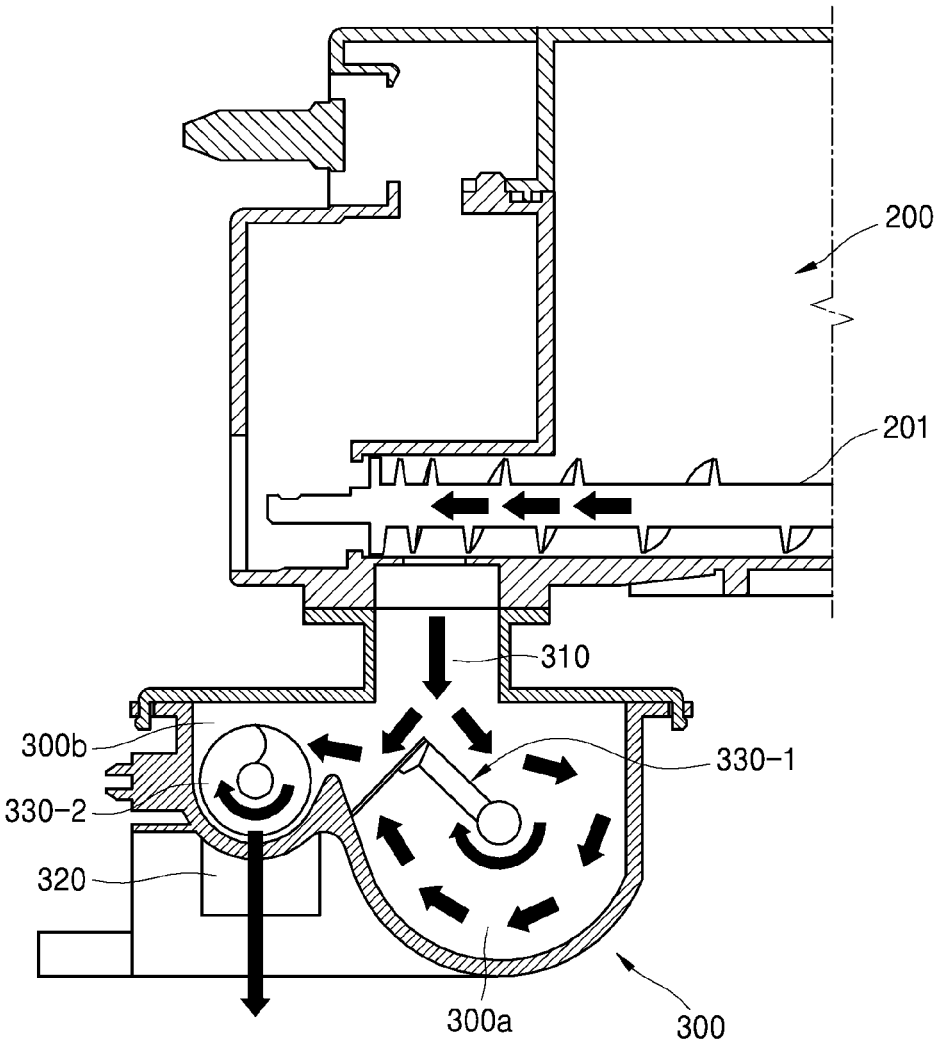
FIG. 9 illustrates a schematic diagram of a toner cartridge and a toner buffer unit when a control unit is in a second feed mode.
Figure 10:
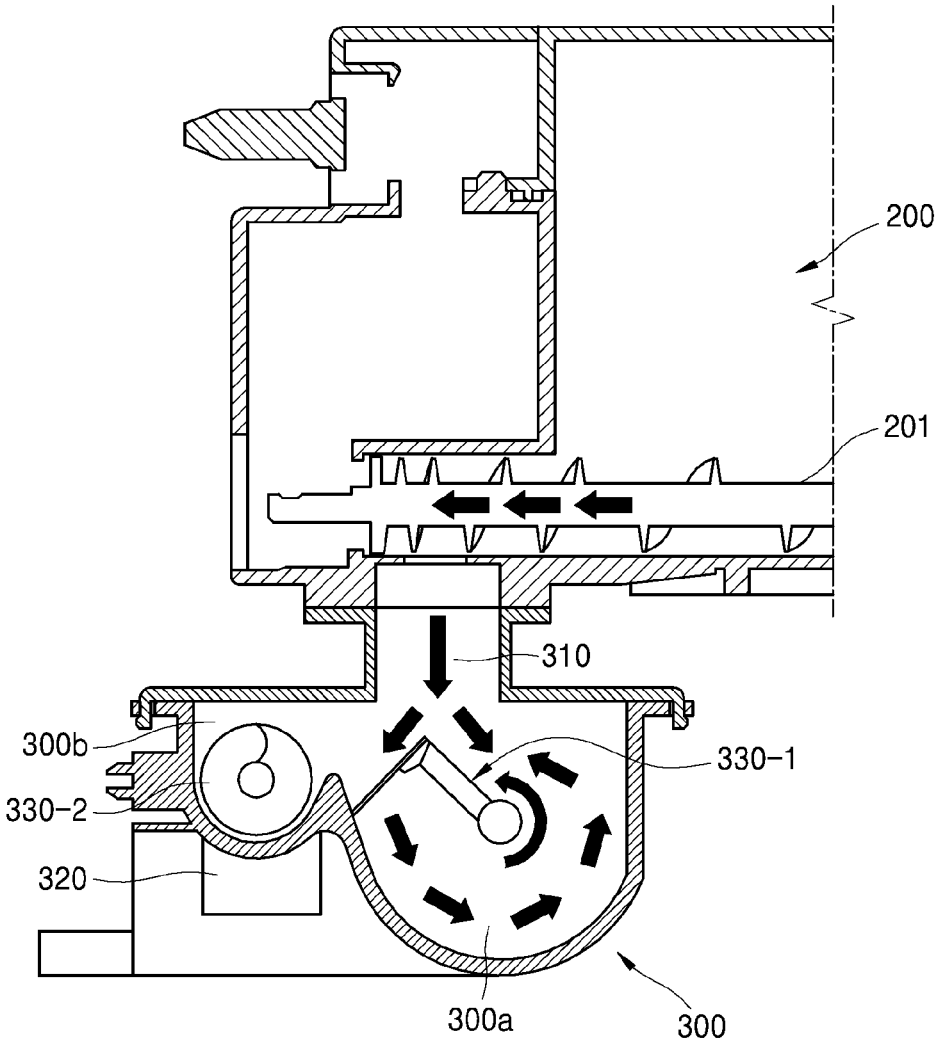
FIG. 10 illustrates a schematic diagram of a toner cartridge and a toner buffer unit when a control unit is in a toner supplement mode.

FIG. 7 illustrates a schematic diagram of the toner cartridge 200 and the toner buffer unit 300 when the control unit 400 is in the stand-by mode, and FIG. 8 illustrates a schematic diagram of the toner cartridge 200 and the toner buffer unit 300 when the control unit 400 is in the first feed mode, and FIG. 9 illustrates a schematic diagram of the toner cartridge 200 and the toner buffer unit 300 when the control unit 400 is in the second feed mode, and FIG. 10 illustrates a schematic diagram of the toner cartridge 200 and the toner buffer unit 300 when the control unit 400 is in the toner supplement mode.

Referring to FIGS. 6 and 7, when the toner concentration detected by the first detection unit 120 exceeds a reference concentration and the toner amount detected by the second detection unit 340 exceeds a reference amount, for example, such as a reference level, the control unit 400 selects the stand-by mode. The control unit 400 controls such that both the first driving unit 510 and the second driving unit 520 are not driving. Since the first driving unit 510 and the second driving unit 520 are not driving, the toner is not fed from the toner cartridge 200 to the toner buffer unit 300 and from the toner buffer unit 300 to the developing unit 100 (referred in FIG. 1). In other words, since the toner concentration in the developing unit 100 and the toner remains in the toner buffer unit 300 are adequate, the toner is not additionally fed to the developing unit 100 and the toner buffer unit 300. The developing roller 101 (referred in FIG. 1) independently moves according to the image formation signal, irrespective of the first driving unit 510 and the second driving unit 520.

Referring to FIGS. 6 and 8, when the toner concentration detected by the first detection unit 120 is less than or equal to the reference concentration and the toner level detected by the second detection unit 340 exceeds the reference level, the control unit 400 selects the first feed mode. Since the toner remains contained inside of the toner buffer unit 300 is adequate, the control unit 400 controls such that the first driving unit 510 is not driving. Thus, the toner is not fed from the toner cartridge 200 to the toner buffer unit 300. Since the first driving unit 510 is not driving, the second carrying member is not moving either. However, since the toner concentration inside of the developing unit 100 is less than or equal to the reference concentration, the control unit 400 drives the second driving unit 520 such that the toner is fed to the developing unit 100. For example, the control unit 400 controls such that the second driving unit 520 rotates in a first direction, for example, a clockwise direction. As the second driving unit 520 rotates clockwise, the agitating member 330-1 and the first carrying member 330-2 may have a clockwise rotation movement. The toner is transferred to the first carrying member 330-2 due to the rotation of the agitating member 330-1 and to the developing unit 100 through the toner outlet 320 due to the rotation of the carrying member 330-2. In the first feed mode, since the toner is fed from the toner buffer unit 300 to the developing unit 100 at a state in which the toner is not fed from the toner cartridge 200 to the toner buffer unit 300, an excessive feeding of the toner to the developing unit 100 may be prevented.

Referring to FIGS. 6 and 9, when the toner concentration detected by the first detection unit 120 is less than or equal to the reference concentration and the toner level detected by the second detection unit 340 is less than or equal to the reference level, the control unit 400 selects the second feed mode. The control unit 400 controls such that the first driving unit 510 and the second driving unit 520 are driving. The second carrying member 201 is moving as the first driving unit 510 is driving, and the agitating member 330-1 and the first carrying member 330-2 are moving as the second driving unit 520 is driving. The toner contained inside of the toner cartridge 200 is fed to the toner buffer unit 300 due to the movement of the second carrying member 201, and the toner in the toner buffer unit 300 is fed to the developing unit 100 due to the movement of the agitating member 330-1 and the first carrying member 330-2. When a printing process requiring a large consumption amount of the toner is continuously progressed at a state in which the toner is not fed from the toner cartridge 200 to the toner buffer unit 300, the toner buffer unit 300 of small size may be depleted of the toner in a short period of time. For example, when the length L1 of the toner buffer unit 300 in the length direction Y of the developing unit 100 is about ⅕ to ½ of the length L2 of the developing unit 100, the toner contained inside of the toner buffer unit 300 may be depleted in a short period of time. This may cause a problem that the printing needs to be halted until a predetermined amount of the toner is charged into the toner buffer unit 300. However, since according to an embodiment, the toner feeding from the toner cartridge 200 to the toner buffer unit 300 and the toner feeding from the toner buffer unit 300 to the developing unit 100 are simultaneously performed in the second feed mode, the under-feeding of the toner to the developing unit 100 may be prevented even when the printing which requires a large consumption amount of the toner is continuously progressed.

As described above, according to an embodiment, when the toner feeding is needed into the developing unit 100, one feed mode of the toner is separately set up into two feed modes, the first and second feed modes, based on the toner level detected by the second detection unit 340, and thus, the excessive feed of the toner to the developing unit 100 as well as the under-feed of the toner may be prevented.

Referring to FIGS. 6 and 10, when the toner concentration detected by the first detection unit 120 exceeds the reference concentration and the toner level detected by the second detection unit 340 is less than or equal to the reference level, the control unit 400 selects the toner supplement mode. In the toner supplement mode, since the toner amount in the developing unit 100 is adequate, the toner is not needed to be fed from the toner buffer unit 300 to the developing unit 100, but since the toner amount inside of the toner buffer unit 300 is insufficient, the toner needs to be fed from the toner cartridge 200 to the toner buffer unit 300.

The control unit 400 feeds the toner from the toner cartridge 200 to the toner buffer unit 300 by controlling the first driving unit 510 to drive the second carrying member 201.

The control unit 400 smoothly feeds the toner from the toner cartridge 200 to the toner buffer unit 300 by controlling the second driving unit 520 to drive the agitating member 330-1 installed on the toner buffer unit 300. When the toner is fed by the second carrying member 201 at a state in which the agitating member 330-1 is not driven, a space in which the toner is not filled up may be formed due to the un-driven agitating member 330-1, and thus, the amount of the toner fed into the toner buffer unit 300 may be reduced.

Also, the control unit 400 allows the second detection unit 340 to precisely detect the toner level by controlling the second driving unit 520 to drive the agitating member 330-1 installed on the toner buffer unit 300, when the toner is fed. In detail, when the toner is being fed, the eccentric cam 333 (referred in FIG. 5) which is arranged on the rotation shaft of the agitating member 330-1 rotates together with the rotation shaft due to the rotation of the agitating member 330-1. The elevator plate 342 (referred in FIG. 3) periodically moves up and down due to the rotation of the eccentric cam 333. Since one end of the elevator plate 342 periodically moves up and down so as not to be buried by the toner, an inaccuracy of the level detection due to the other end of the elevator plate 342 being buried by the toner may be prevented.

Since the toner concentration inside of the developing unit 100 is adequate in the toner supplement mode, the first carrying member 330-2, unlike the agitating member 330-1, is preferred not to be driven. According to an embodiment, a control using the second driving unit 520 without an additional driving unit may be performed to drive the agitating member 330-1 while the first carrying member 330-2 is not driven.

As an embodiment, a driving transfer member 350, which selectively transfers the driving force of the second driving unit 520 to the first carrying member 330-2, may be arranged between the second driving unit 520 and the first carrying member 330-2. For example, the driving transfer member 350 may be a one-way clutch. When the second driving unit 520 drives in the first direction, for example, in the clockwise direction, the driving transfer member 350 transfers the driving force of the second driving unit 520 to the second carrying member 201, and rotates the second carrying member 201. On the other hand, when the second driving unit 520 drives in the second direction, for example, in the counter-clockwise direction, the driving transfer member 350 blocks the transfer of the driving force of the second driving unit 520 to the second carrying member 201 and does not rotate the second carrying member 201. In this case, the agitating member 330-1 which is directly connected to the second driving unit 520 rotates with the second driving unit 520, regardless of the rotation direction of the second driving unit 520. For example, when the second driving unit 520 is driven to rotate in the first direction, the agitating member 330-1 rotates in the first direction, and when the second driving unit 520 is driven to rotate in the second direction, the agitating member 330-1 rotates in the second direction.

According to an embodiment described above, the driving transfer member 350, which is relatively simple, inexpensive, and not an additional driving unit, is used as a structural component to prevent the toner from being fed to the developing unit 100 when the toner is supplemented by the toner buffer unit 300. With this arrangement, the toner supplement of the toner buffer unit 300 may be quickly performed while the cost is reduced and the size increase of the unit may be prevented.

Since the second driving unit 520 drives only in the second direction in the toner supplement mode, the second direction of the second driving unit 520 may be synchronized with the driving of the first driving unit 510. Accordingly, when the second driving unit 520 starts driving in the second direction, the first driving unit 510 starts to drive, and when the second driving unit 520 ends driving in the second direction, the first driving unit 510 ends driving also.

According to an embodiment described above, a case of the driving transfer member 350 being the one-way clutch is mainly explained, but an embodiment is not limited thereto, and it is certainly possible that the driving transfer member 350 may, regardless of the rotation direction of the second driving unit 520, selectively transfer the driving force of the second driving unit 520 to the first carrying member 330-2 based on the value detected by the first detection unit 120. For example, when the value detected by the first detection unit 120 satisfies the reference value but the second driving unit 520 does not rotate in the second direction but only in the first direction, the driving transfer member 350 blocks the transfer of the driving force of the second driving unit 520 to the first carrying member 330-2, and when the value detected by the first detection unit 120 does not satisfy the reference value, the driving transfer member 350 transfers the driving force of the second driving unit 520 to the first carrying member 330-2.

Figure 11:
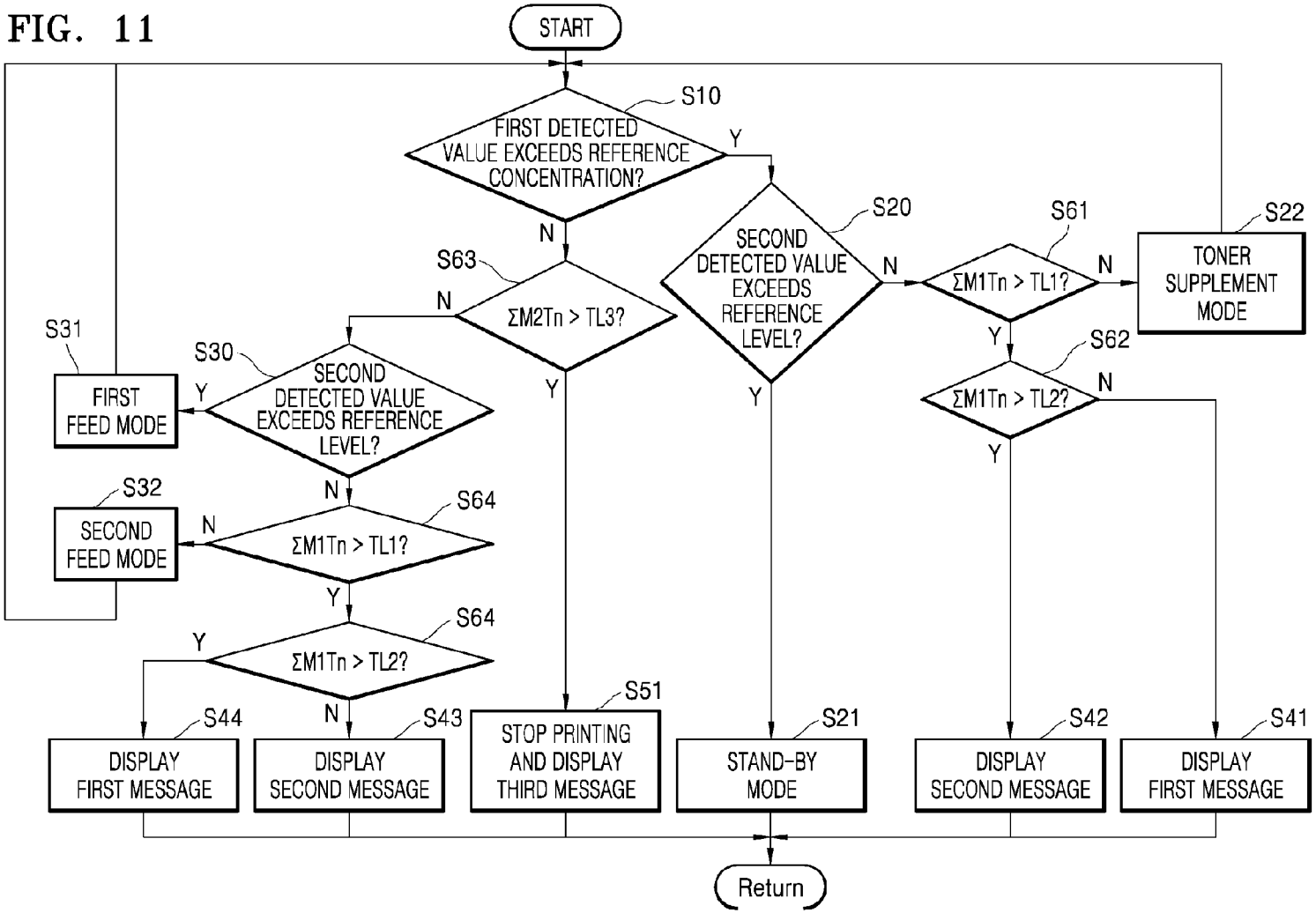
FIG. 11 is a flow chart of exemplary adjustment of the toner feeding in the eletrophotographic image forming apparatus according to an embodiment.

FIG. 11 is a flow chart of exemplary adjustment of the toner feeding in the eletrophotographic image forming apparatus according to an embodiment. Referring to FIG. 11, the control unit 400 determines whether the value detected by the first detection unit 120 (hereafter a first detected value) satisfies a first reference value, for example, the reference concentration S10. For example, whether the first detected value exceeds the reference concentration is determined.

When the first detected value satisfies the reference concentration, the control unit 400 determines whether the value detected by the second detection unit 340 (hereafter a second detected value) satisfies a second reference value, for example, the reference level S20. For example, whether the second detected value exceeds the reference level is determined. When the second detected value satisfies the reference level, the control unit 400 performs the stand-by mode S21. In the stand-by mode, both the first driving unit 510 and the second driving unit 520 stop driving.

When the second detected value does not satisfy the reference level, for example, is less than or equal to the reference level, the control unit 400 performs the toner supplement mode S22. In the toner supplement mode, the control unit 400 drives the first driving unit 50 and the second driving unit 520 in the second direction. The second carrying member 201 is driven by the first driving unit 510. The first carrying member 330-2 is not driven, but only the agitating member 330-1 is driven in the second direction of the second driving unit 520. Accordingly, the toner is charged into the toner buffer unit 300 while the toner is not fed to the developing unit 100.

When the second detected value does not satisfy the reference level, a driving time ΣM1Tn of the first driving unit 510 is checked S61, S62. Whether the driving time ΣM1Tn of the first driving unit 510 exceeds a first reference time TL1 is determined, and if it exceeds, whether it exceeds a second reference time TL2 which is bigger than the first reference time TL1 is determined. When the driving time ΣM1Tn of the first driving unit 510 exceeds the first reference time TL1, it may be estimated that the feed speed of the toner from the toner buffer cartridge 200 to the toner buffer unit 300 is less than a first reference speed, and thus that the amount of the toner inside of the toner cartridge 200 is at an insufficient or inadequate state. For example, the inadequate state may indicate that the amount of the toner inside of the toner cartridge 200 is less than about 5% of the initial amount of the toner inside of the toner cartridge 200.

Also, when the driving time ΣM1Tn of the first driving unit 510 exceeds the second reference time TL2, it may be estimated that the feed speed of the toner from the toner cartridge 200 to the toner buffer unit 300 is less than a second reference speed which is less than the first reference speed, and thus that the amount of the toner is at an almost none state. For example, the almost none state may indicate that the amount of the toner inside of the toner cartridge 200 is less than about 1% of the initial amount of the toner.

As described above in detail, when the driving time ΣM1Tn of the first driving unit 510 exceeds the first reference time TL1 and less than or equal to the second reference time TL2, the control unit 400 may determine a state that the toner is not smoothly fed from the toner cartridge 200 to the toner buffer unit 300. Accordingly, the control unit 400 may display a first message S41 on a display unit 600. A message for preparing a replacement of the toner cartridge 200, for example, 'Near Empty' may be displayed as the first message. When the driving time ΣM1Tn of the first driving unit 510 exceeds the first reference time TL1 and the second reference time TL2, the control unit 400 may determine a state in which the toner is not fed from the toner cartridge 200. Accordingly, the control unit 400 may display a second message S42 on a display unit 600. A message for replacing the toner cartridge 200, for example, 'Empty' may be displayed as the second message. Steps for storing the driving time ΣM1Tn of the first driving unit 510 and resetting may be appropriately arranged, although not illustrated in FIG. 11.

On the other hand, when the first detected value does not satisfy the reference concentration, the control unit 400 determines whether the second detected value of the second detection unit 340 satisfies the reference level S30.

When the second detected value satisfies the reference level, the control unit 400 performs the first feed mode S31. In the first feed mode, the first driving unit 510 is stopped, and the second driving unit 520 is driven in the positive direction. Since the first driving unit 510 is stopped, the second carrying member 201 is not driven. The agitating member 330-1 and the first carrying member 330-2 arranged inside of the toner buffer unit 300 is driven by the positive driving of the second driving unit 520. Accordingly, the toner is fed from the toner buffer unit 300 to the developing unit 100 at a state in which the toner is not fed from the toner cartridge 200 to the toner buffer unit 300.

When the second detected value does not satisfy the reference level, the control unit 400 performs the second feed mode S32. In the second feed mode, the first driving unit 510 is driven, and the second driving unit 520 is driven in the positive direction. The second carrying member 201 is driven by the driving of the first driving unit 510, and the agitating member 330-1 and the first carrying member 330-2 are driven by the driving in the positive direction of the second driving unit 520. Accordingly, the toner is fed from the toner buffer unit 300 to the developing unit 100 at a state in which the toner is fed from the toner cartridge 200 to the toner buffer unit 300.

When the first detected value does not satisfy the reference concentration, the driving time ΣM2Tn of the second driving unit 520 is checked S63. When the driving time ΣM2Tn of the second driving unit 520 exceeds a third reference time TL3, it may be estimated as a state in which the toner is not smoothly fed from the toner buffer unit 300 to the developing unit 100. Accordingly, when the driving time ΣM2Tn of the second driving unit 520 exceeds the third reference time TL3, the control unit 400 stops the printing process, and displays a third message S51 on the display unit 600. A message of 'Feed Error" may be displayed as the third message. Steps for storing the driving time ΣM2Tn of the second driving unit 520 and resetting may be appropriately arranged, although not illustrated.

When the second detected value does not satisfy the reference level, a driving time ΣM1Tn of the first driving unit 510 is checked S64, S65. Whether the driving time ΣM1Tn of the first driving unit 510 exceeds a first reference time TL1 is determined, and if it exceeds, whether it exceeds a second reference time TL2 which is bigger than the first reference time TL1 is determined. When the driving time ΣM1Tn of the first driving unit 510 exceeds the first reference time TL1, it may be estimated that the feed speed of the toner from the toner buffer cartridge 200 to the toner buffer unit 300 is less than a first reference speed, and thus that the amount of the toner inside of the toner cartridge 200 is at an insufficient or inadequate state. For example, the inadequate state may indicate that the amount of the toner inside of the toner cartridge 200 is less than about 5% of the initial amount of the toner inside of the toner cartridge 200. Also, when the driving time ΣM1Tn of the first driving unit 510 exceeds the second reference time TL2, it may be estimated that the feed speed of the toner from the toner cartridge 200 to the toner buffer unit 300 is less than a second reference speed which is less than the first reference speed, and thus that the amount of the toner is at an almost none state. For example, the almost none state may indicate a state in which the amount of the toner inside of the toner cartridge 200 is less than about 1% of the initial amount of the toner.

As described above in detail, when the driving time ΣM1Tn of the first driving unit 510 exceeds the first reference time TL1 and less than or equal to the second reference time TL2, the control unit 400 may determine a state that the toner is not smoothly fed from the toner cartridge 200 to the toner buffer unit 300. Accordingly, the control unit 400 may display a first message S43 on a display unit 600. A message for preparing a replacement of the toner cartridge 200, for example, 'Near Empty' may be displayed as the first message. When the driving time ΣM1Tn of the first driving unit 510 exceeds the first reference time TL1 and the second reference time TL2, the control unit 400 may determine a state in which the toner is not fed from the toner cartridge 200. Accordingly, the control unit 400 may display a second message S44 on the display nit 600. A message for replacing the toner cartridge 200, for example, 'Empty' may be displayed as the second message. Steps for storing the driving time ΣM1Tn of the first driving unit 510 and resetting may be appropriately arranged, although not illustrated in FIG. 11

In one or more embodiments described above in detail, an image forming apparatus using a black toner is described, but the scope of embodiments is not limited thereto. The above image forming apparatus may be applicable to an image forming apparatus which forms images on a recording material, using various methods adopted by an image forming apparatus that forms color images using toners of cyan C, magenta M, yellow Y, and black B colors. An image forming apparatus according to an embodiment explains a developing apparatus which adopts the two-component toner as an example, but the scope of embodiments is not limited thereto. For example, the image forming apparatus according to an embodiment may be applicable to an image forming apparatus adopting a one-component toner. Also, the first driving unit 510 is mainly explained with an example of driving the second carrying member 201 arranged inside of the toner cartridge 200, but the scope of embodiments are not limited thereto, and may be appropriately modified without question. For example, the second carrying member 201 may be a structural member to rotate the main body of the toner cartridge 200, and the first driving unit 510 may drive such second carrying member 201.

As described above, according to one or more embodiments, an eletrophotographic image forming apparatus may realize a stable toner feeding by selective driving of the carrying member and the agitating member inside the toner buffer unit with only one motor, and the miniaturization of the apparatus size also.

According to one or more embodiments, an eletrophotographic image forming apparatus may prevent an excessive feeding of the toner in the general image forming process, and a shortage of the toner in a case when an image forming process requiring a large amount of the toner is continuously progressed.

According to one or more embodiments, an eletrophotographic image forming apparatus may charge the toner to the toner buffer unit in a short period of time in the toner supplement mode.

It should be understood that exemplary embodiments described therein should be considered in a descriptive sense only and not for purposes of limitation. Descriptions of features or aspects within each embodiment should typically be considered as available for other similar features or aspects in other embodiments.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. An eletrophotographic image forming apparatus comprising:

a developing unit;

a toner buffer unit which is connected to the developing unit and which feeds a toner to the developing unit, the toner buffer unit includes an agitating member which agitates the toner contained inside the toner buffer unit and a first carrying member which carries the toner contained inside to the developing unit, and a length of the toner buffer unit in the longitudinal direction of the developing unit is about ⅕ to about ½ of a length of the developing such that the toner buffer unit is smaller than the developing unit;

a toner cartridge which is connected to the toner buffer unit and which feeds the toner to the toner buffer unit, the toner cartridge includes a second carrying member which carries the toner contained inside the toner cartridge to the toner buffer unit; and a control unit which controls a first driving unit which drives the second carrying member and a second driving unit which drives the agitating member and the first carrying member, wherein the control unit selects one of a plurality of modes comprising:

a first feed mode in which the toner is not fed from the toner cartridge to the toner buffer unit and which the toner is fed from the toner buffer unit to the developing unit, a second feed mode in which the toner is fed from the toner cartridge to the toner buffer unit and in which the toner is fed from the toner buffer unit to the developing unit, and a toner supplement mode in which the toner is fed from the toner cartridge to the toner buffer unit and in which the toner is not fed from the toner buffer unit to the developing unit.

2. The eletrophotographic image forming apparatus of claim 1, wherein the control unit controls the first driving unit not to drive the second carrying member in the first feed mode, and controls the first driving unit to drive the second carrying member in the second feed mode and the toner supplement mode.

3. The eletrophotographic image forming apparatus of claim 2, wherein the control unit controls the second driving unit to drive the agitating member and the first carrying member in the first and second feed modes, and controls the second driving unit not to drive the first carrying member but to drive the agitating member in the toner supplement mode.

4. The eletrophotographic image forming apparatus of claim 3, wherein a driving transfer member is arranged between the second driving unit and the first carrying member and selectively transfers a driving force of the second driving unit to the first carrying member.

5. The eletrophotographic image forming apparatus of claim 4, wherein a driving transfer member is a one-way clutch.

6. The eletrophotographic image forming apparatus of claim 4, wherein:

the second driving unit is rotatable in a first direction and a second direction opposite to the first direction, the driving transfer member transfers the driving force of the second driving unit to the first carrying member, when the second driving unit rotates in the first direction, and the driving transfer member blocks the transfer of the driving force of the second driving unit to the first carrying member, when the second driving member rotates in the second direction.

7. The eletrophotographic image forming apparatus of claim 6, wherein the driving force of the second driving unit is transferred to the agitating member, when the second driving unit rotates in the first and second directions.

8. The eletrophotographic image forming apparatus of claim 6, wherein the control unit synchronizes the driving of the second driving unit in the second direction with the driving of the first driving unit.

9. The eletrophotographic image forming apparatus of claim 1, further comprising a first detection unit which detects a concentration of the toner within the developing unit and a second detection unit which detects the toner level of the toner buffer unit, wherein the control unit selects one of the first feed mode, the second feed mode, and the toner supplement mode, based on detection values respectively obtained by the first detection unit and the second detection unit.

10. The eletrophotographic image forming apparatus of claim 9, wherein:

the control unit selects the first feed mode when the value detected by the first detection unit does not satisfy a first reference value and the value detected by the second detection unit satisfies a second reference value, the control unit selects the second feed mode when the value detected by the first detection unit does not satisfy the first reference value and the value detected by the second detection unit does not satisfy the second reference value, and the control unit selects the toner supplement mode when the value detected by the first detection unit satisfies the first reference value and the value detected by the second detection unit does not satisfy the second reference value.

11. The eletrophotographic image forming apparatus of claim 1, wherein the control unit determines the toner remains of the toner cartridge based on a driving time of the first driving unit.

12. The eletrophotographic image forming apparatus of claim 11, further comprising a display unit which displays a message indicating the amount of toner which remains in the toner cartridge.

13. The eletrophotographic image forming apparatus of claim 1, wherein a center of the agitating member is positioned lower than a center of the first carrying member.

14. The eletrophotographic image forming apparatus of claim 9, wherein:

the second detection unit includes an elevator member which moves according to the toner level in the toner buffer unit and a sensor unit to detect a location of the elevator member, and the elevator member includes a rotating supporting shaft and an elevator plate which extends from the rotating supporting shaft to move up and down in accordance with the toner level.

* * * * *